US011970825B1

(12) United States Patent
Ling

(10) Patent No.: US 11,970,825 B1
(45) Date of Patent: Apr. 30, 2024

(54) STRUCTURALLY STABLE GARDEN BRIDGE AND ITS METHOD OF USE

(71) Applicant: BEST CART, INC, Ontario, CA (US)

(72) Inventor: Kai Ling, Ningbo (CN)

(73) Assignee: BEST CART, INC, Ontario, CA (US)

( * ) Notice: Subject to any disclaimer, the term of this patent is extended or adjusted under 35 U.S.C. 154(b) by 0 days.

(21) Appl. No.: 18/379,184

(22) Filed: Oct. 12, 2023

(51) Int. Cl.
*E01D 4/00* (2006.01)
*E01D 2/04* (2006.01)
*E01D 19/10* (2006.01)

(52) U.S. Cl.
CPC ..... *E01D 4/00* (2013.01); *E01D 2/04* (2013.01); *E01D 19/103* (2013.01)

(58) Field of Classification Search
CPC ..... E01D 2/04; E01D 4/00; E01D 19/103
USPC ..... 14/3, 5, 6, 9, 13, 14, 24
See application file for complete search history.

(56) References Cited

U.S. PATENT DOCUMENTS 2,507,354 A * 5/1950 Spunberg ..... A63H 33/044 446/105
3,768,108 A * 10/1973 Wadsworth ..... E01D 15/133 14/24
4,965,903 A * 10/1990 Bish ..... F16B 7/18 14/2.4
6,799,345 B2 * 10/2004 Occhiolini ..... E01D 6/00 14/12
D670,404 S * 11/2012 Fissette ..... D25/62
8,973,195 B2 * 3/2015 Breault ..... E01D 4/00 14/2.4
2013/0198978 A1 * 8/2013 Pohlman ..... E01D 1/00 29/428

* cited by examiner

*Primary Examiner* — Raymond W Addie
(74) *Attorney, Agent, or Firm* — Jose Cherson Weissbrot

(57) ABSTRACT

The present invention discloses a structurally stable garden bridge comprising at least one pedestal structure, the pedestal structure comprising at least one elevated pedestal and at least one grounding base; at least one scaffold structure, the scaffold structure comprising at least one elevated side frame and at least one grounding side frame; wherein one end of the elevated pedestal is connected to one grounding base, the other end of the elevated pedestal is connected to another grounding base, forming the pedestal structure; wherein the elevated side frame is connected to one grounding side frame at one end and to another grounding side frame at the other end of the elevated side frame, forming the scaffold structure, the scaffold structure being fixedly attachable to the pedestal structure.

18 Claims, 15 Drawing Sheets

STRUCTURALLY STABLE GARDEN BRIDGE AND ITS METHOD OF USE

TECHNICAL FIELD

The present invention relates to the technical field of bridges, in particular to a structurally stable garden bridge and its method of use.

BACKGROUND

With the improvement of people's living standard, more and more people play in parks to enjoy the natural scenery or rest and recreation. In order to create a beautiful scenery in the park, usually set up a small stream, and the small stream will be built on the bridge for pedestrians to walk, for people to walk to see the scenery.

However, most of the garden bridges on the market are spliced in two sections, and the bridge deck can only be about 1.5 meters; the bridge deck is shorter resulting in a smaller bearing capacity and a less solid structure. For example, U.S. Pat. No. 4,965,903 of the United States patent disclosure of a garden bridge, there is a short bridge, bearing force is small, and the structure is not strong enough problem; Similarly, the U.S. Pat. No. 7,240,387 of the United States patent disclosure of a garden bridge, there is a short bridge, bearing force is insufficient, not strong enough problem.

Based on the above problems, it is necessary to invent a new structurally stable garden bridge, which has a longer bridge deck, better bearing capacity, more solid and stable, and gives users a better experience.

SUMMARY

The present invention provides a structurally stable garden bridge comprising at least one set of pedestal structures; and each set of the pedestal structure comprises an elevated pedestal and two grounding bases; and the elevated pedestal is provided with at least one threaded hole A at each end; and wherein one end of the grounding base contacts the ground and the other end is provided with at least one connecting section and at least one first embedded body, the connecting section has at least one threaded hole B thereon, the first embedded body is fixedly connected to the elevated pedestal, and the threaded hole A and the threaded hole B are coaxial when the elevated pedestal and the grounding base are fixedly connected; and at least one set of the scaffold structure; and each set of the scaffold structure comprises one elevated side frame and two grounding side frames; and at least one through hole C is provided at each end of the elevated side frame; and wherein one end of the grounding side frame contacts the ground and the other end is provided with at least one through hole D and at least one second embedded body, the second embedded body is fixedly coupled to the elevated side frame, and the through hole C and the through hole D are coaxial when the elevated side frame is fixedly coupled to the grounding side frame; and wherein the elevated pedestal is further provided with at least one through hole E at each end of the elevated pedestal, the through hole E being transverse to the threaded hole A, and the elevated side frame is further provided with at least one through hole F corresponding to the through hole E at each end of the elevated side frame, and the scaffold structure and the pedestal structure are formed into a fixed connection through the through hole E and the through hole F.

The present invention also provides A method of using a structurally stable garden bridge comprising providing an elevated pedestal and two grounding bases, an elevated side frame and two grounding side frames; and connecting one end of the elevated pedestal to one of the grounding bases and the other end of the elevated pedestal to the other of the grounding bases to form a pedestal structure; and connecting one end of the elevated side frame to one of the grounding side frames and the other end of the elevated side frame to the other of the grounding side frames to form a scaffold structure; and connecting one of the scaffold structures to one side of the pedestal structure to form a bridge; and placing and securing the bridge where it is to be placed in the garden.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the drawings.

Figure 1:
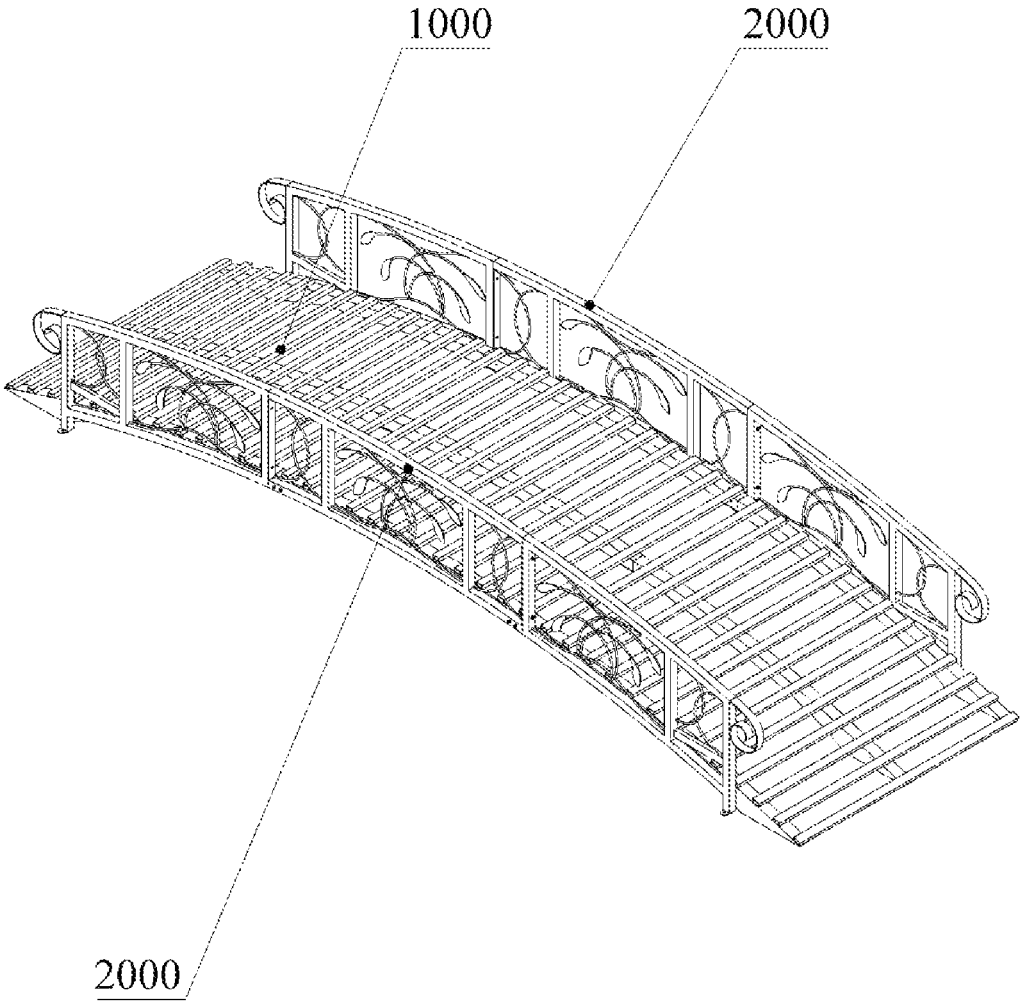
FIG. 1 is a schematic diagram I of a structurally stable garden bridge.

1000, pedestal structure; 1100, elevated pedestal; 1101, elevated support rod; 1102, elevated side bar; 1103, threaded hole A; 1104, through hole E; 1200, grounding base; 1201, grounding support rod; 1202, grounding side bar; 1203, connecting section; 1204, threaded hole B; 1205, first embedded body; 1300, crossbar; 2000, scaffold structure; 2100, elevated side frame; 2101, elevated bottom pole; 2102, elevated connecting rod; 2103, elevated top bar; 2104, through hole C; 2105, through hole F; 2200, grounding side frame; 2201, grounding bottom pole; 2202, grounding connecting rod; 2203, grounding top bar; 2204, through hole D; 2205, second embedded body; 2206, grounding rod; 2207, reinforcement rod; 2208, grounding section; 2209, fixing hole; 2300, support pole; 2400, extension section.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1 to 12, the present invention provides a garden bridge with a stable structure. In this embodiment, it includes at least one set of pedestal structures 1000. Each set of pedestal structures 1000 comprises an elevated pedestal 1100 and two grounding bases 1200. The elevated pedestal 1100 is equipped with at least one threaded hole A 1103 at each end. One end of the grounding base 1200 is in contact with the ground, while the other end is equipped with at least one connecting section 1203 and at least one first embedded body 1205. The first embedded body 1205 is fixedly connected to the elevated pedestal 1100, and when the elevated pedestal 1100 and the grounding base 1200 are fixedly connected, the threaded hole A 1103 and the threaded hole B 1204 are coaxial.

In this embodiment, it also includes at least one set of scaffold structures 2000. Each set of scaffold structures 2000 comprises an elevated side frame 2100 and two grounding side frames 2200. The elevated side frame 2100 is equipped with at least one through hole C 2104 at each end. One end of the grounding side frame 2200 is in contact with the ground, while the other end is equipped with at least one through hole D 2204 and at least one second embedded body 2205. The second embedded body 2205 is fixedly connected to the elevated side frame 2100, and when the elevated side frame 2100 and the grounding side frame 2200 are fixedly connected, the through hole C 2104 and the through hole D 2204 are coaxial.

In this embodiment, each end of the elevated pedestal is also equipped with at least one through hole E 1104. The through hole E 1104 is transverse to the threaded hole A 1103. Each end of the elevated side frame 2100 is also equipped with at least one through hole F 2105 corresponding to the through hole E 1104. The scaffold structure 2000 and the pedestal structure 1000 are fixedly connected via the through hole E 1104 and the through hole F 2105.

In this embodiment, both the pedestal structure 1000 and the scaffold structure 2000 are designed as hollow structures. The lightweight nature of hollow structures reduces the overall mass of the bridge, thereby reducing the load-bearing pressure and deformation on both foundation and structure. Moreover, hollow structures require less material, resulting in lower costs and resource conservation. They also offer high space utilization, facilitating flexible layout and modification. Additionally, they exhibit good mechanical properties and can withstand large loads and moments.

In other embodiments (not shown in figures), both pedestal structure 1000 and scaffold structure 2000 are not limited to hollow structures but can also be designed as solid structures. Solid structures have higher strength and stiffness, enabling them to withstand greater loads and moments. They also have good durability, being less susceptible to factors such as temperature, humidity, corrosion, etc., and can be designed as any desired structure.

As shown in FIGS. 5 to 9, in this embodiment, the elevated pedestal 1100 includes at least one elevated support rod 1101, at least one elevated side bar 1102, and at least one crossbar 1300. The crossbar 1300 is laid on the elevated support rod and the elevated side bar 1102. The grounding base 1200 includes at least one grounding support rod 1201, at least one grounding side bar 1202, and several crossbars 1300. The crossbars 1300 are laid on the grounding support rod and the grounding side bar 1202 and are fixedly connected to the elevated support rod 1101 and the elevated side bar 1102.

In this embodiment, the above structure of the pedestal structure prevents water accumulation on the bridge during rainy days. It also has a simple structure that is easy to clean. In other embodiments (not shown in figures), both the elevated pedestal and the grounding base are not limited to structures with crossbars. They can also be designed as plates with through holes, wire mesh layouts, or any other desired structures that allow pedestrian access.

In this embodiment, several crossbars 1300 are fixedly connected to the elevated support rod 1101 and the elevated side bar 1102 by welding. In other embodiments, corresponding connection holes can be opened on the crossbars 1300, elevated support rod 1101, and elevated side bar 1102. They can be fixedly connected by screws, pins, rivets, or other connectors. They can also be designed using any other desired connection method.

Figure 2:
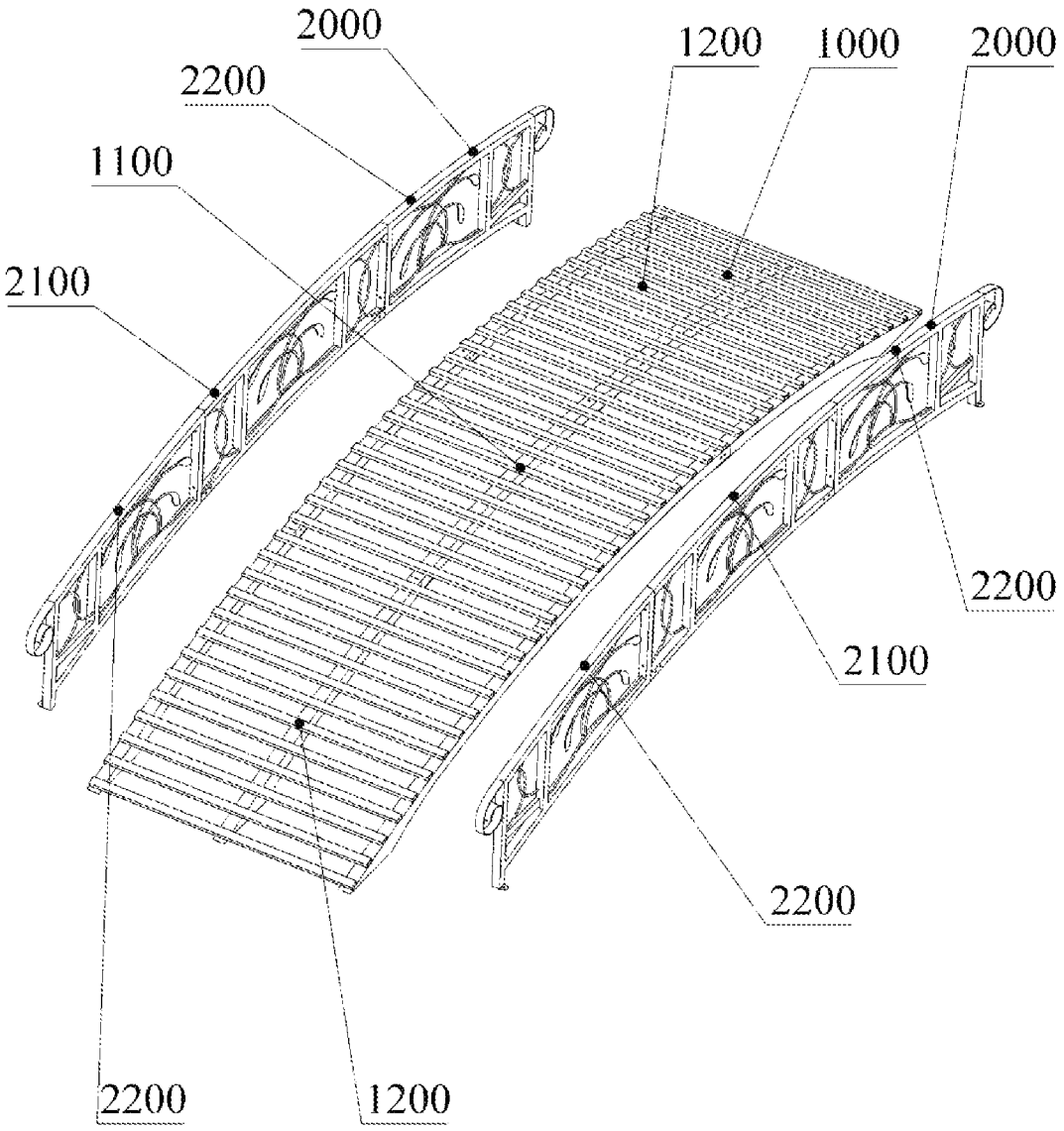
FIG. 2 is a schematic diagram II of a structurally stable garden bridge.
Figure 3:
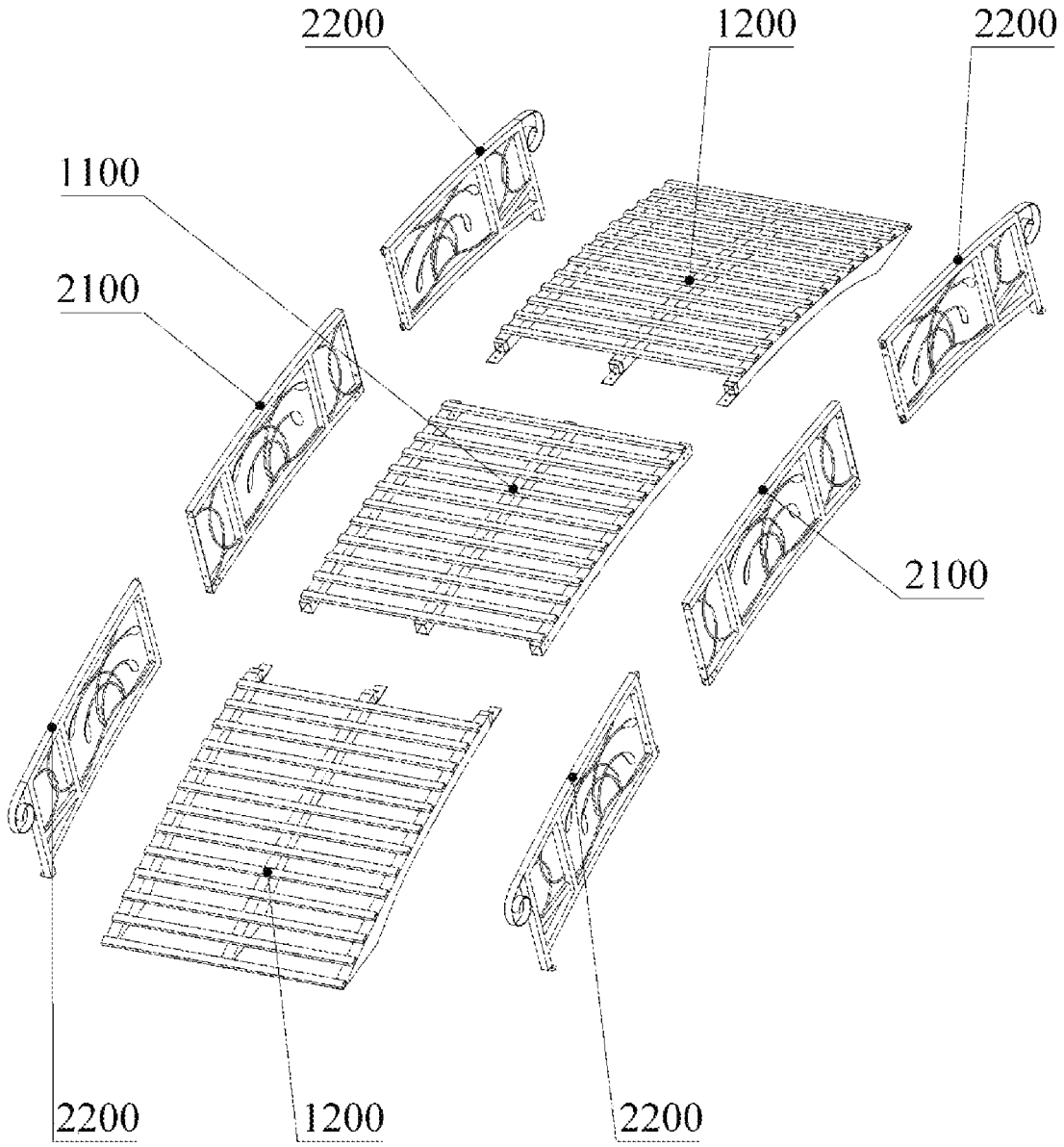
FIG. 3 is an exploded view of a structurally stable garden bridge.
Figure 4:
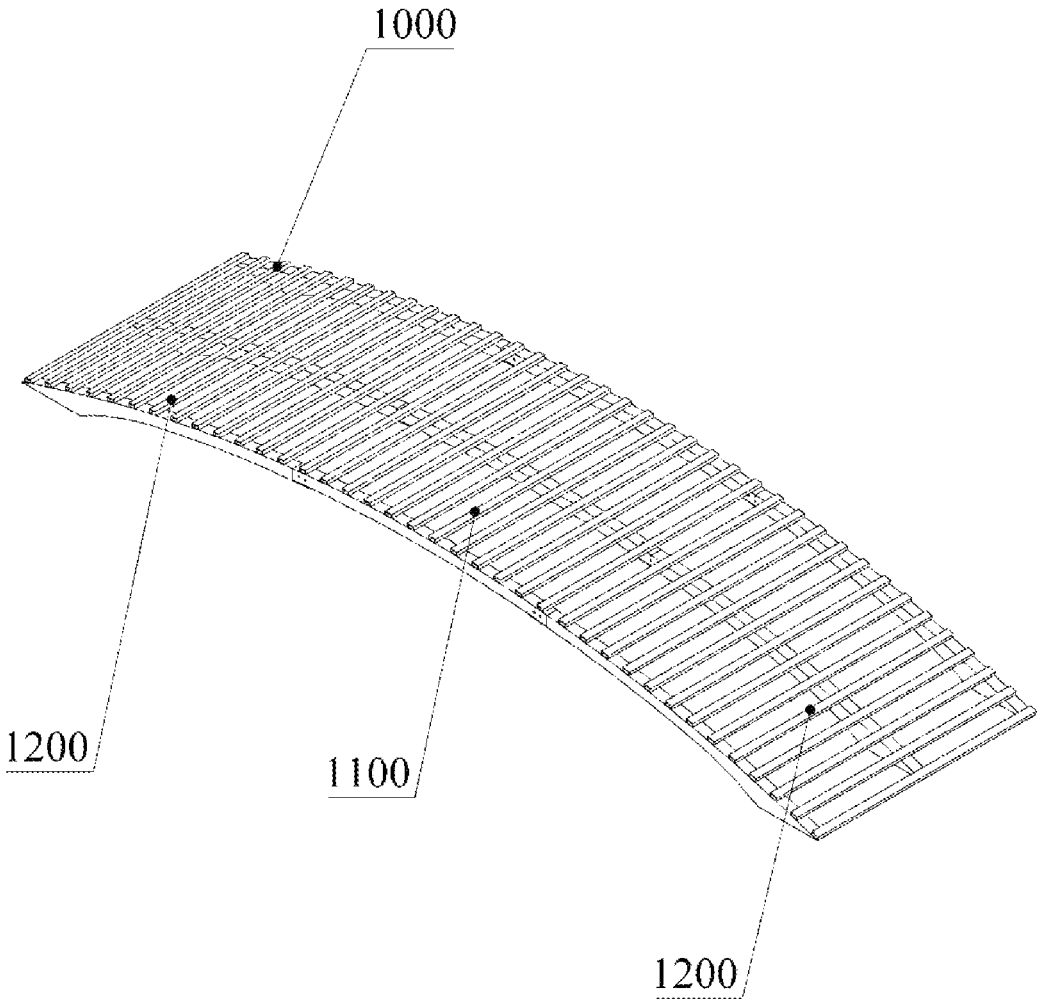
FIG. 4 is a schematic diagram of a pedestal structure.
Figure 5:
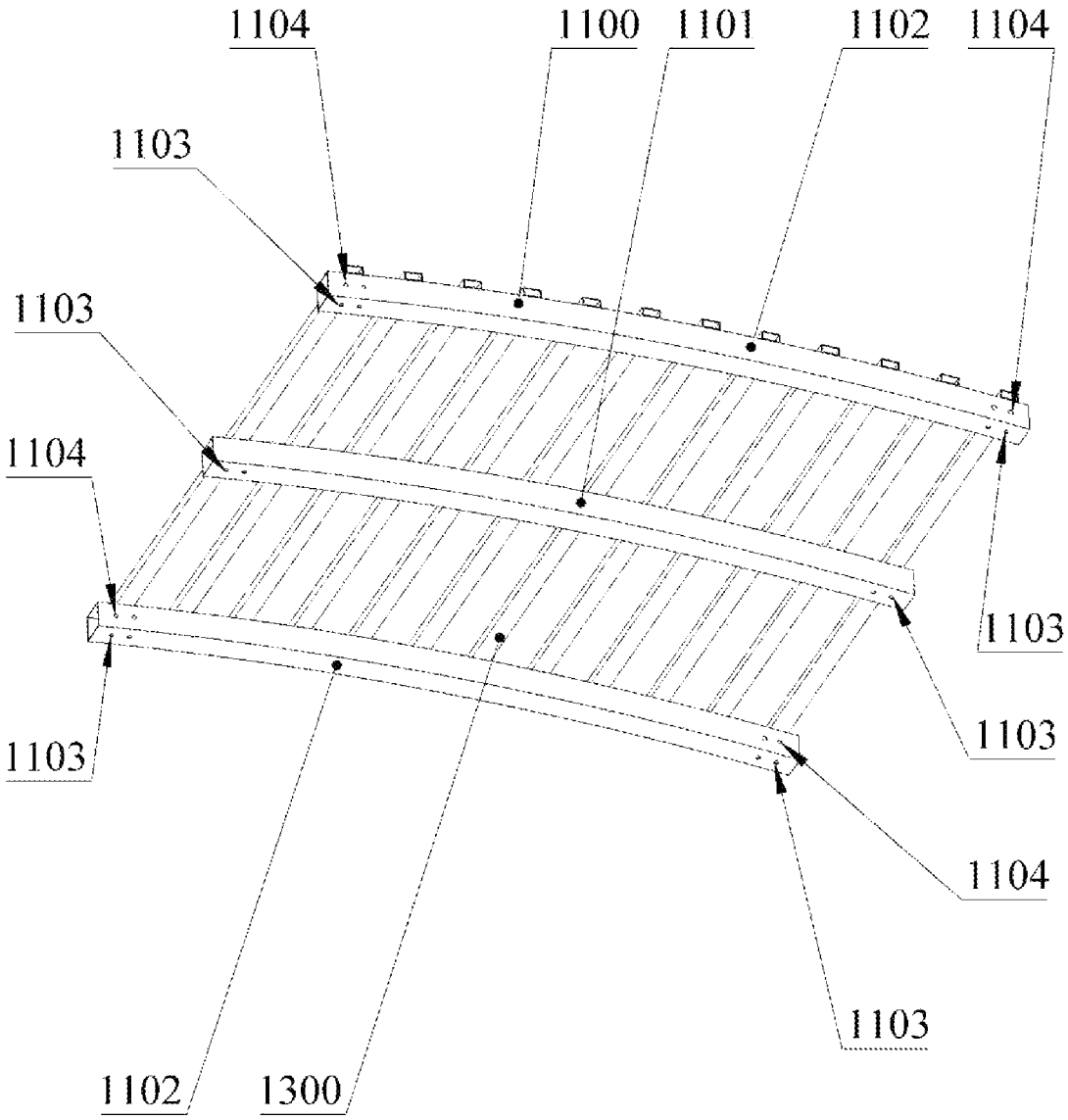
FIG. 5 is a schematic diagram of an elevated pedestal.
Figure 6:
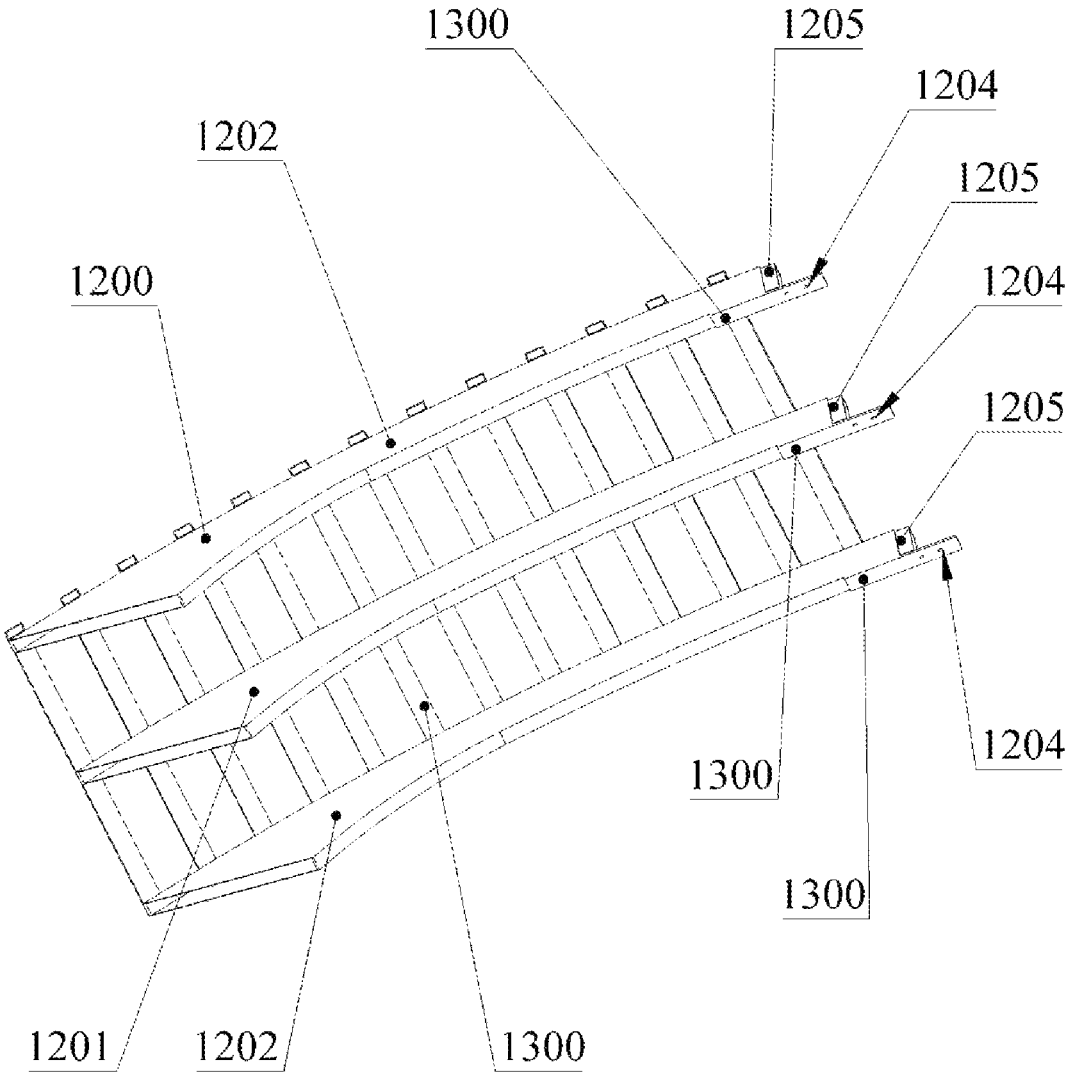
FIG. 6 is a schematic diagram of a grounding base.

As shown in FIGS. 1 to 2, in this embodiment, the bridge is an arch bridge. The pedestal structure 1000 is designed as an arc, with the elevated support rod 1101 and the elevated side bar 1102 serving as the curved rods at the upper end. The grounding side bar 1202 and the grounding support rod 1201 are designed as the rods at the lower end of the corresponding arc. The crossbar is designed as a straight rod.

In other embodiments, the pedestal structure 1000 can also be designed as a parabolic shape to better withstand uniformly distributed loads. It can also be designed as an arc shape, which is more suitable for bearing concentrated loads. Other possible geometric shapes include semicircles, polygons, ellipses, ovals, horseshoes, and any other desired structures.

As shown in FIGS. 5 to 12, in this embodiment, the elevated support rod 1101 and the elevated side bar 1102 are each provided with at least one threaded hole A 1103 at both ends. One end of the grounding support rod 1201 is provided with at least one connecting section 1203, and one end of the grounding side bar 1202 is provided with at least one connecting section 1203.

In this embodiment, the elevated support rod 1101 is fixedly connected to the grounding support rod 1201 by a fixing member, and the elevated side bar 1102 is fixedly connected to the grounding side bar 1202 by a fixing member, so that the elevated pedestal 1100 is fixedly connected to the grounding base 1200.

Specifically, when the elevated support rod 1101 is fixedly connected to the grounding support rod 1201, one end of the elevated support rod 1101 is set on the connecting section 1203 of the grounding support rod 1201, and when the elevated side bar 1102 is fixedly connected to the grounding side bar 1202, one end of the elevated side bar 1102 is set on the connecting section 1203 of the grounding side bar 1202.

In this embodiment, screws are used as fixing members. In other embodiments, fixing members can also be set as screws, pins, rivets, welding pins and other fixing members that meet your requirements. In other embodiments, the connection between the elevated support rod 1101 and the grounding support rod 1201 and between the elevated side bar 1102 and the grounding side bar can be any connection method that meets your requirements, such as welding, buckling, bonding, seaming and other connection methods.

As shown in FIGS. 7 to 12, in this embodiment, the elevated side frame 2100 comprises at least one elevated bottom pole 2101, at least one elevated connecting rod 2102, at least one elevated top bar 2103, and at least one support pole 2300. The lower end of the elevated connecting rod 2102 is fixedly connected to one end of the elevated bottom pole 2101, and the upper end of the elevated connecting rod 2102 is fixedly connected to one end of the elevated top bar 2103. The elevated connecting rod 2102 is respectively arranged at both ends of the elevated bottom pole 2101 and the elevated top bar 2103, and the support pole 2300 is arranged between the elevated bottom pole 2101 and the elevated top bar 2103 and parallel to the elevated connecting rod 2102.

In this embodiment, the elevated bottom pole 2101, the elevated connecting rod 2102, the elevated top bar 2103, and the support pole 2300 are integrally formed and fixedly connected. In other embodiments (not shown in figures), the connection between the elevated bottom pole 2101, the elevated connecting rod 2102, the elevated top bar 2103, and the support pole 2300 is not limited to integral forming. It can also be a screw connection, a pin connection, a welding connection, or any other desired connection method.

Figure 9:
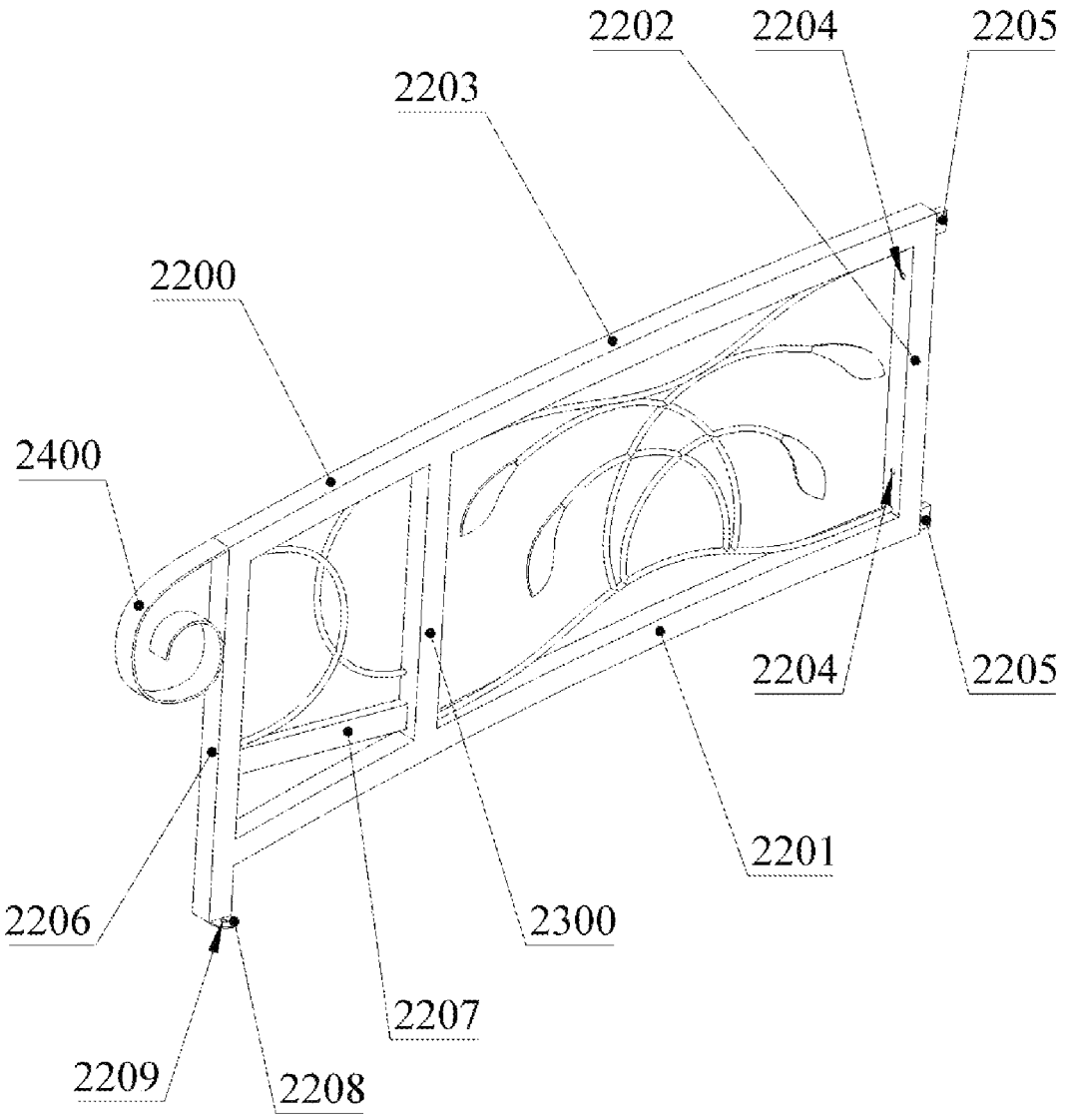
FIG. 9 is a schematic diagram of a grounding side frame.
Figure 10:
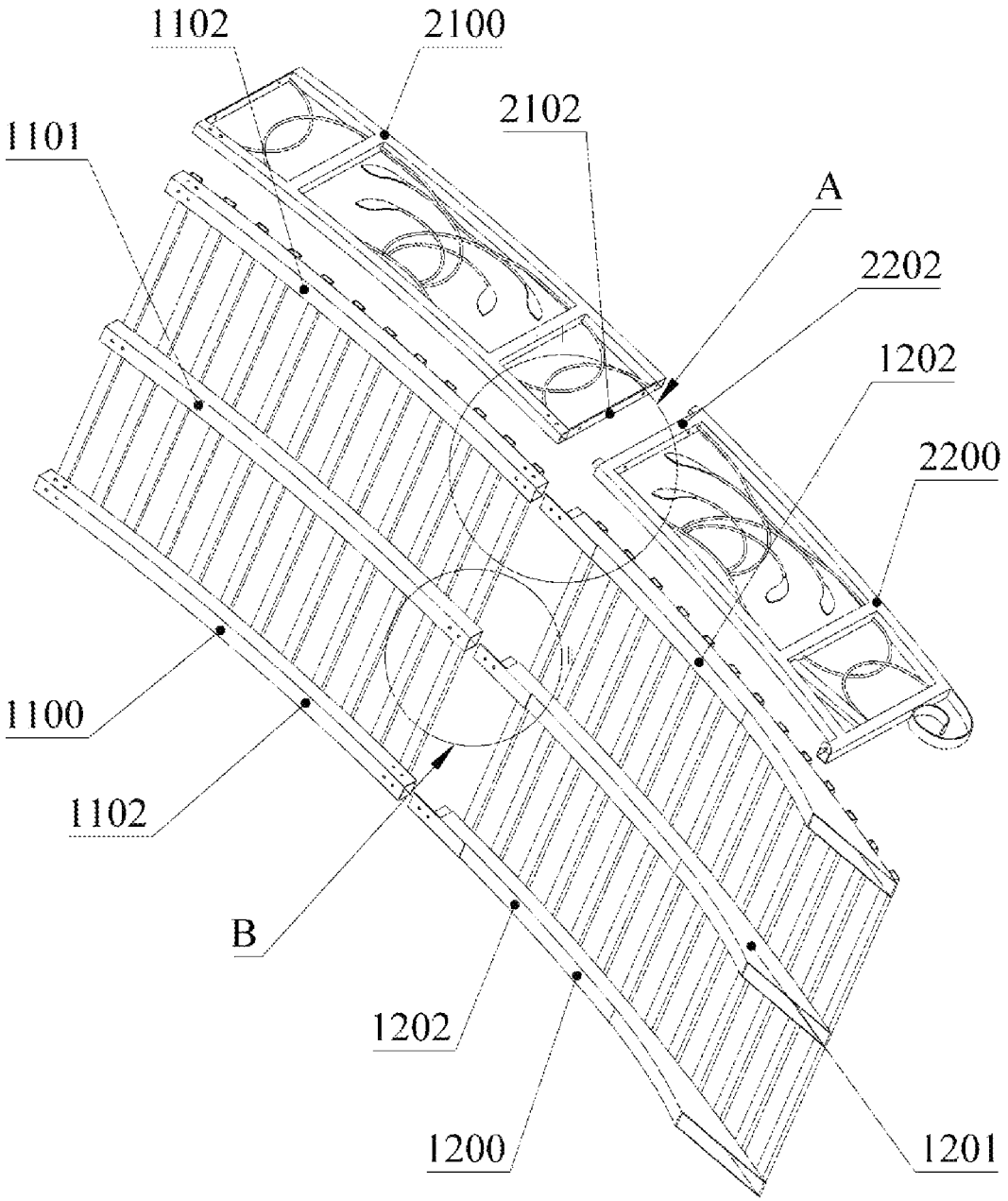
FIG. 10 is another exploded view of a structurally stable garden bridge.
Figure 11:
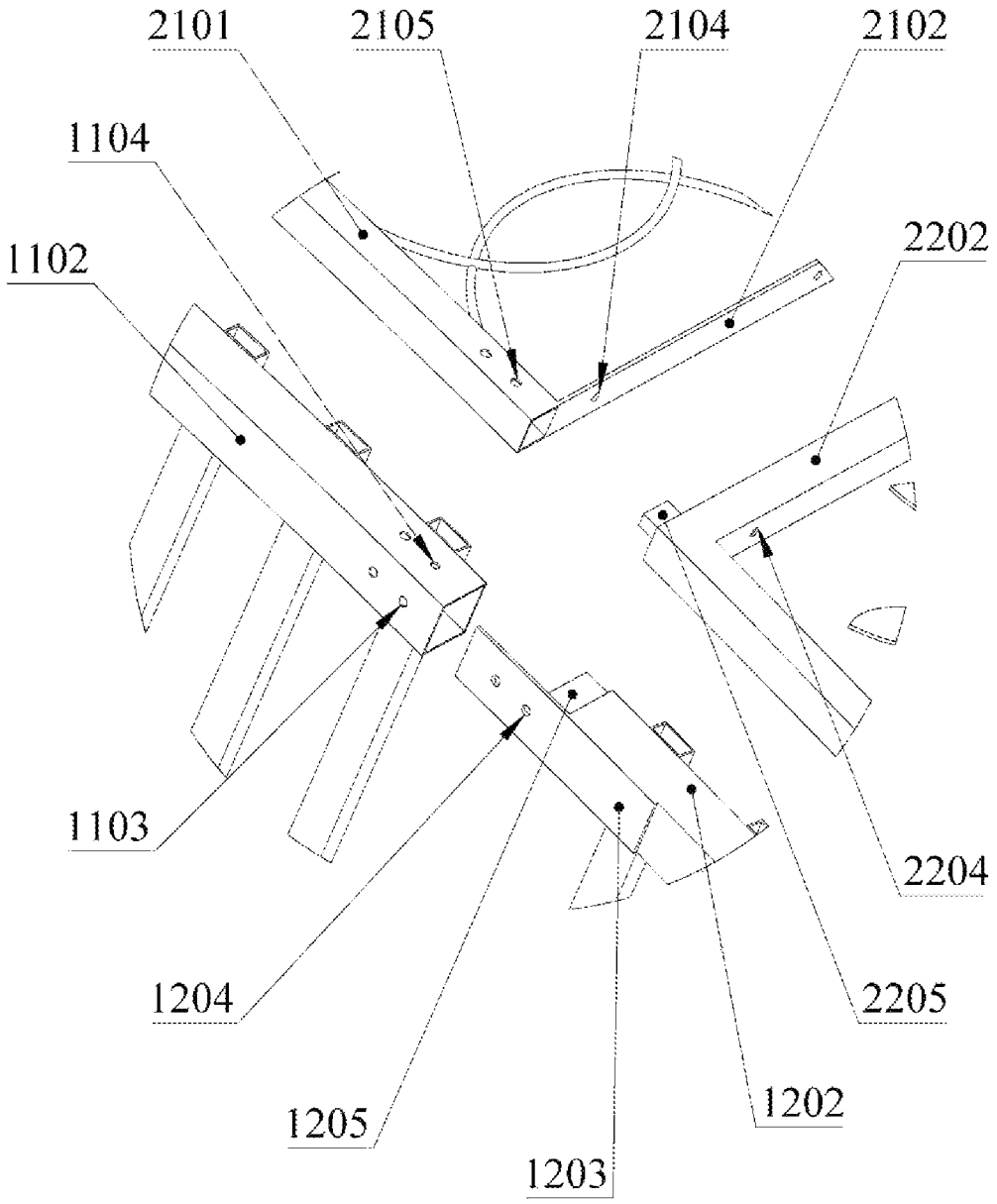
FIG. 11 is an enlarged schematic view at A in FIG. 10.
Figure 12:
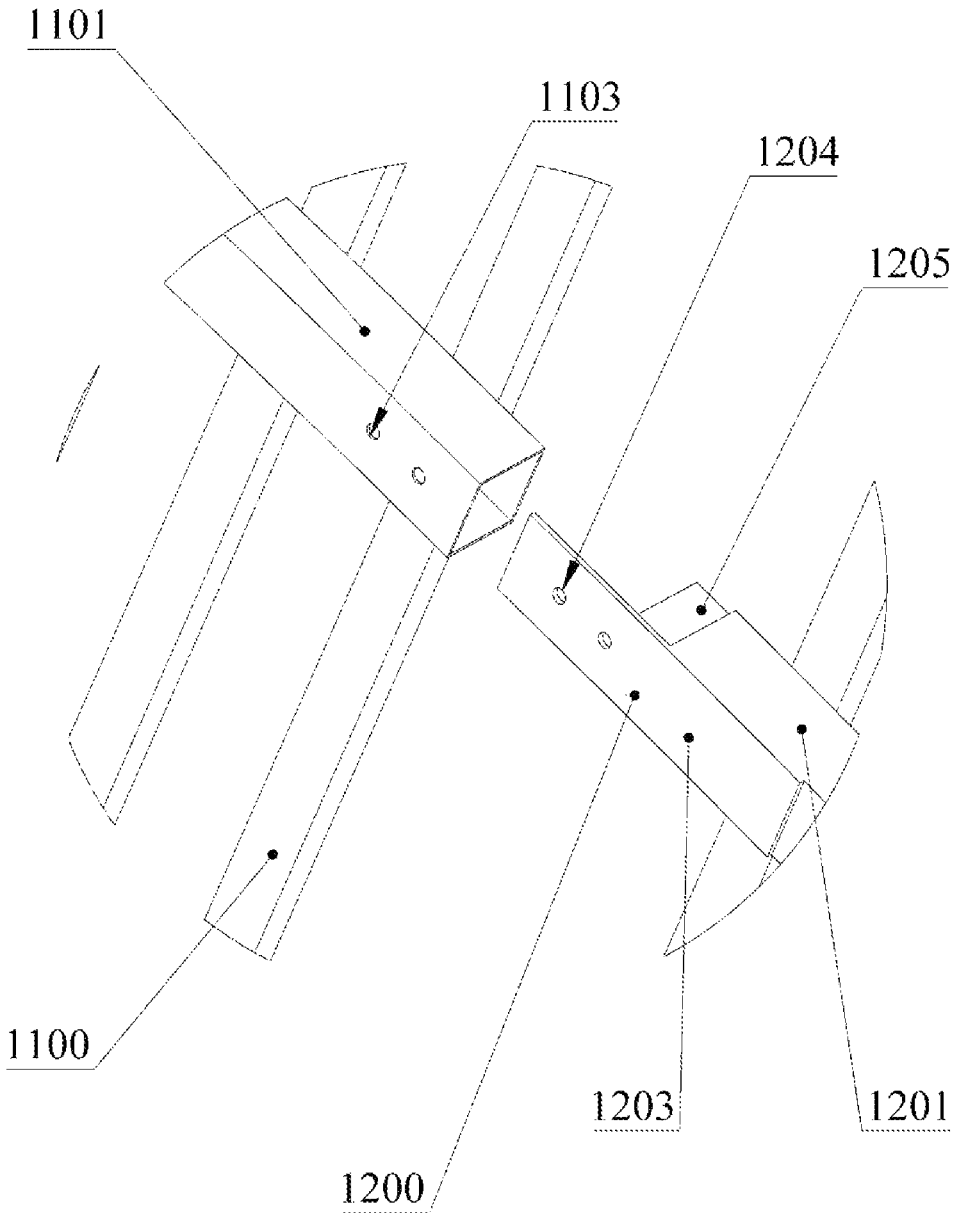
FIG. 12 is an enlarged schematic view at B in FIG. 10.
Figure 13:
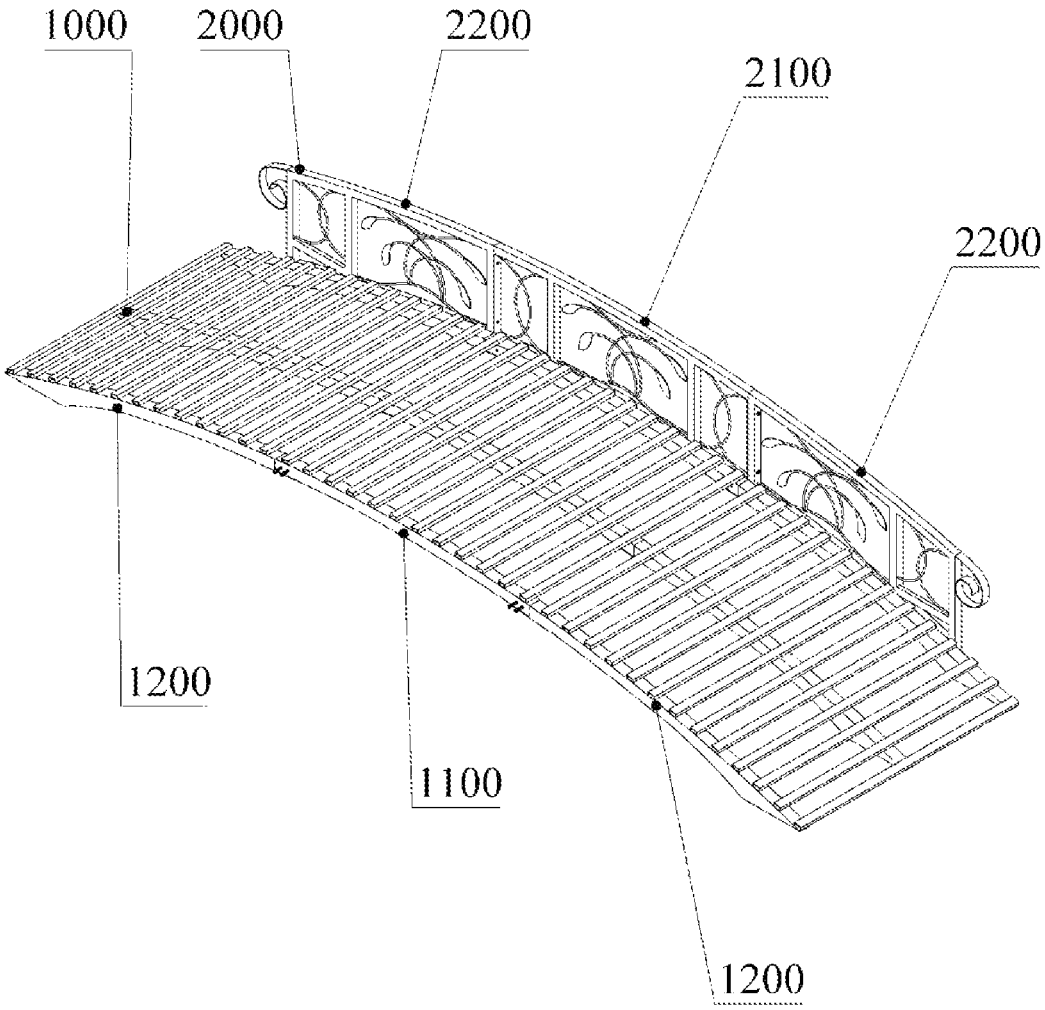
FIG. 13 is another schematic view of a structurally stable garden bridge.
Figure 14:
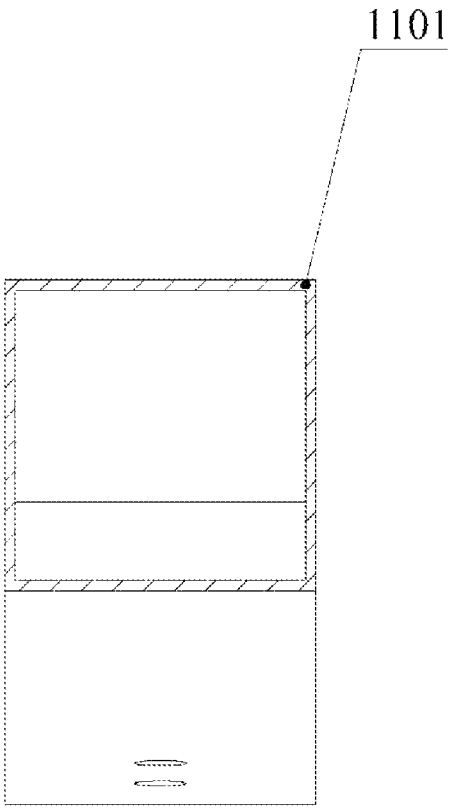
FIG. 14 is a sectional view of an elevated support rod.
Figure 15:
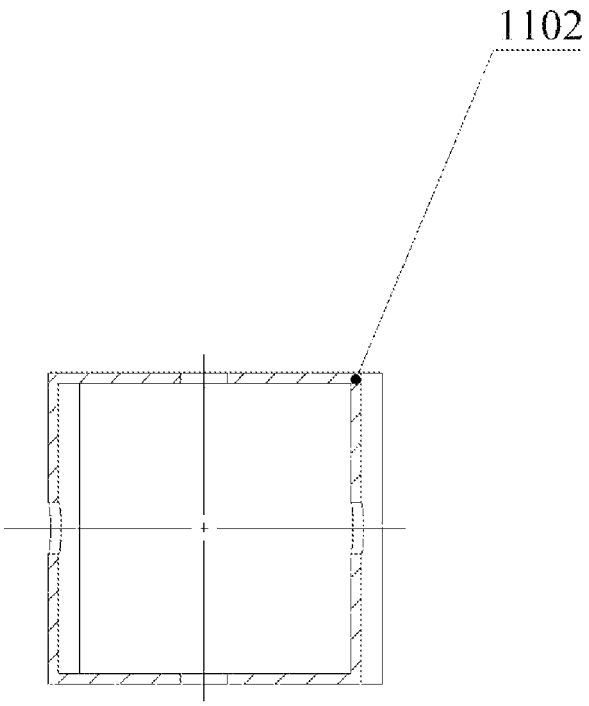
FIG. 15 is a sectional view of an elevated side bar.

As for grounding side frame 2200 shown in FIG. 9, it comprises at least one grounding bottom pole 2201, at least one grounding connecting rod 2202, at least one grounding top bar 2203, at least one support pole 2300 and at least one grounding rod 2206.

Wherein, the lower end of grounding connecting rod 2202 is fixedly connected to one end of grounding bottom pole 2201. The upper end of grounding connecting rod 2202 is fixedly connected to one end of grounding top bar 2203. Support pole is set between overhead bottom pole and overhead top bar parallel to overhead connecting rod. The other end of grounding bottom pole is fixedly connected to grounding rod. The other end of grounding top bar is fixedly connected to upper end of grounding rod. Grounding rod is parallel to grounding connecting rod.

In this embodiment, grounding bottom pole, grounding connecting rod, grounding top bar, support pole and grounding rod are integrally formed and fixedly connected. In other embodiments (not shown in figures), connection between grounding bottom pole, grounding connecting rod, grounding top bar, support pole and grounding rod is not limited to integral forming. It can also be screw connection, pin connection or welding connection or any other desired connection method.

As shown in FIGS. 7 to 12, in this embodiment, the elevated connecting rod 2102 is provided with at least one through hole C 2104, and the grounding connecting rod 2202 is provided with at least one through hole D 2204 corresponding to the through hole C 2104. The elevated connecting rod 2102 and the grounding connecting rod 2202 are fixedly connected by a fixing member.

In this embodiment, the fixing member is a screw and a nut. In other embodiments, the fixing member can also be set as a screw, a pin, a rivet, a welding pin, or any other fixing member that meets the requirements. In some embodiments, the connection between the elevated connecting rod 2102 and the grounding connecting rod 2202 is not limited to being connected by a fixing member, but can also be set as welding, buckle, adhesive, seam connection, or any other connection method that meets the requirements.

As shown in FIGS. 4 to 12, in this embodiment, at least one through hole E 1104 is provided at both ends of the elevated side bar 1102, and at least one through hole F 2105 corresponding to the through hole E 1104 is provided at both ends of the elevated bottom pole 2101. The elevated side bar 1102 and the elevated bottom pole 2101 are fixedly connected by a fixing member.

In this embodiment, the fixing member is a screw and a nut. In other embodiments, the fixing member can also be set as a screw, a pin, a rivet, a welding pin, or any other fixing member that meets the requirements. In some embodiments, the connection between the elevated side bar 1102 and the elevated bottom pole 2101 is not limited to being connected by a fixing member but can also be set as welding, buckle, adhesive, seam connection or any other connection method that meets the requirements.

Figure 7:
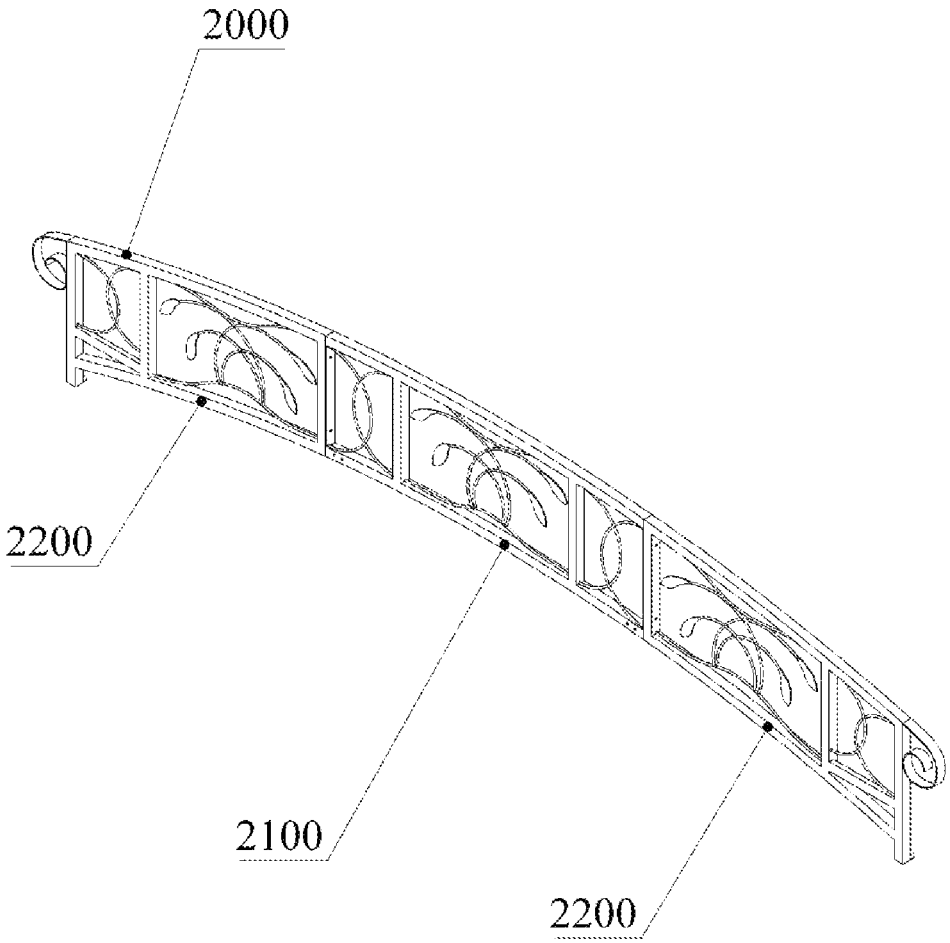
FIG. 7 is a schematic diagram of a scaffold structure.
Figure 8:
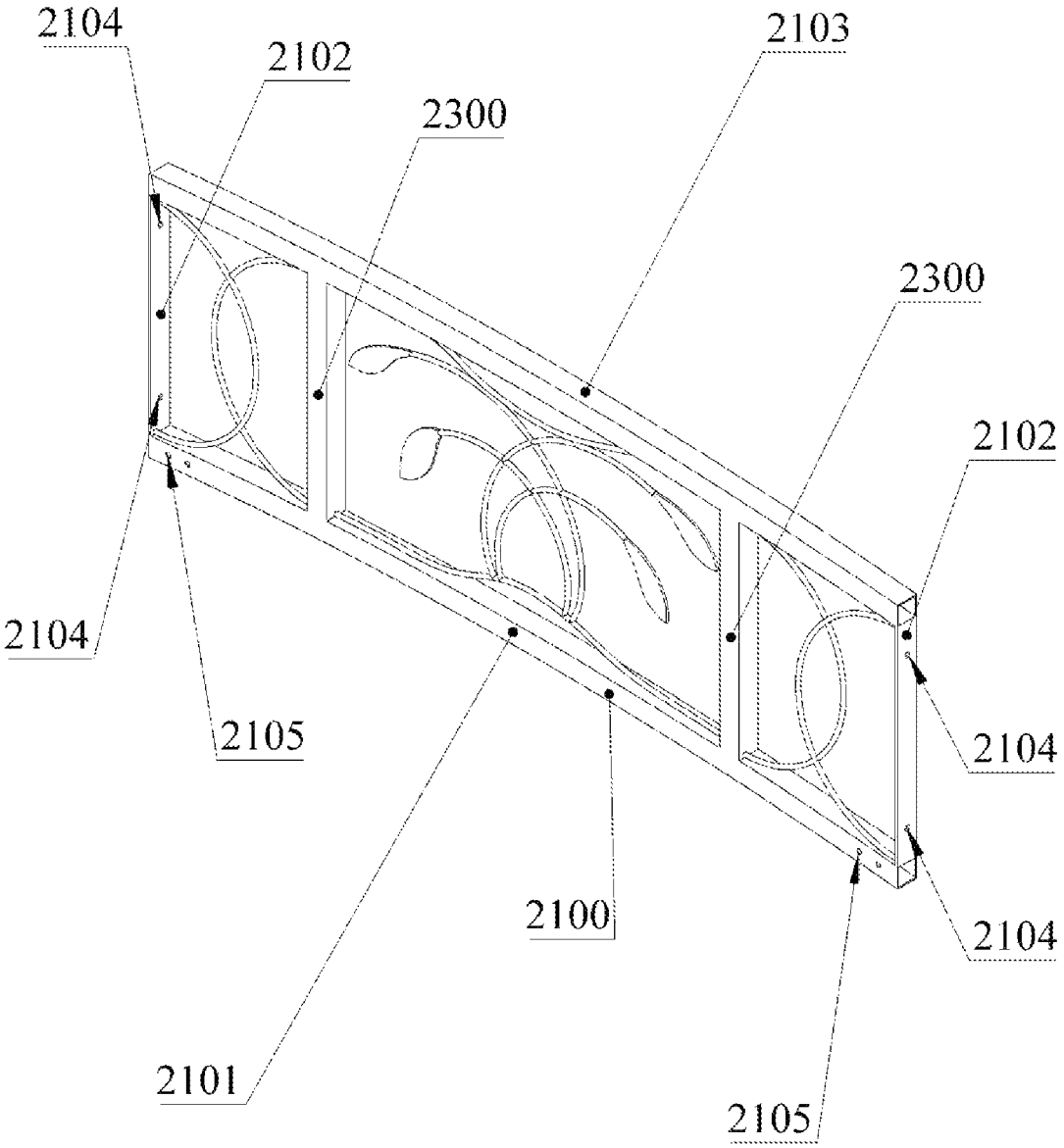
FIG. 8 is a schematic diagram of an elevated side frame.

As shown in FIG. 7, in this embodiment, the scaffold structure 2000 is provided with patterns of plant leaves and plant vines as barrier structures. This patterned barrier structure serves as a barrier to protect pedestrians when crossing the bridge. At the same time, it increases the ornamental value of the bridge and provides people with pleasant visual experience.

In other embodiments (not shown in the figure), barrier structures are not limited to patterns of plant leaves and plant vines but can also be set as arrays of lines or randomly distributed circles or any other geometric patterns that meet your requirements.

As shown in FIGS. 4 to 12, in this embodiment, the grounding side bar 1202 and the grounding support rod 1201 are provided with a first embedded body 1205 at one end near the connecting section 1203. The outer diameter of the first embedded body 1205 is not greater than the inner diameter of the elevated side bar 1102 and the elevated support rod 1101. When the first embedded body 1205 is fixedly connected to the elevated pedestal 1100, the first embedded body 1205 of the grounding side bar 1202 and the grounding support rod 1201 is inserted into the elevated side bar 1102 and the elevated support rod 1101, and the surfaces are closely fitted. The setting of the first embedded body 1205 increases the stability of the pedestal structure and facilitates the connection between the elevated pedestal 1100 and the grounding base 1200, providing users with a safer and more convenient experience.

In other embodiments, the first embedded body 1205 can be set such that its inner diameter is not smaller than the outer diameter of the elevated side bar 1102 and the elevated support rod 1101. In other embodiments, the first embedded body 1205 can be set on the elevated side bar 1102 and the elevated support rod 1101.

As shown in FIGS. 7 to 12, in this embodiment, the grounding connecting rod 2202 is provided with a second embedded body 2205 at a position corresponding to the elevated top bar 2103 and the elevated bottom pole 2101. The outer diameter of the second embedded body 2205 is not greater than the inner diameter of the elevated top bar 2103 and the elevated bottom pole 2101. When the second embedded body 2205 is fixedly connected to the elevated side frame 2100, the second embedded body 2205 of the grounding connecting rod 2202 is inserted into the elevated top bar 2103 and the elevated bottom pole 2101, and their surfaces are closely fitted. In other embodiments, the second embedded body 2205 can be set on the elevated connecting rod 2102 of the elevated side frame 2100. The setting of the second embedded body 2205 increases the stability of the scaffold structure, facilitates connection between the elevated side frame 2100 and the grounding side frame 2200, providing users with a safer and more convenient experience.

As shown in FIG. 9, in this embodiment, the grounding side frame 2200 includes at least one reinforcement rod 2207. The reinforcement rod 2207 is set between the support pole 2300 and the grounding rod 2206 and has a certain angle with the support pole 2300. The setting of the reinforcement rod increases the stability of the grounding side frame, further enhances the safety of the bridge, and provides users with a safer experience.

In this embodiment, the reinforcement rod is perpendicular to the support pole. In other embodiments (not shown in the figure), the reinforcement rod is not limited to being perpendicular to the support pole but can also be set at any angle that meets your requirements, such as 30° or 60°.

As shown in FIG. 9, in this embodiment, the grounding section 2208 is provided at the bottom end of the grounding rod 2206, and the grounding section 2208 is provided with at least one fixing hole 2209. In this embodiment, the bridge is fixedly connected to the ground through a fixing hole, which can be connected by screws, pins, or any other connection method that meets your requirements.

In the example shown in FIG. 9, the grounding side frame 2200 is also provided with at least one extension part 2400, and the extension part 2400 is set at the corresponding position of the grounding top rod 2203 on the grounding pole. The setting of the extension part 2400 can further improve the safety of users when using the bridge.

In this example, the extension part 2400 is set in a spiral shape. In other examples (not shown in the figure), the extension part 2400 is not limited to a spiral shape and can also be set to a circular, semi-circular, arc-shaped, or any other geometric shape that meets the requirements.

In some examples, there are also heightening frames, which are set above the frame structure. Specifically, the heightening frame includes an overhead heightening frame and a ground heightening frame. The overhead heightening frame is fixedly connected to the overhead top rod, and the ground heightening frame is fixedly connected to the ground top rod. Specifically, both the overhead heightening frame and the ground heightening frame are provided with a barrier structure with a plant vine pattern, and the ground heightening frame is provided with a handrail.

Wherein, the connection method between the overhead heightening frame and the overhead top rod and between the ground heightening frame and the ground top rod can be set to bolt connection, pin connection, welding, or any other connection method that meets your requirements. In some examples, the heightening frame is directly fixedly connected to the frame structure, and its connection method can be set to bolt connection, pin connection, welding or any other connection method that meets your requirements.

In this embodiment, the method of using a structurally stable garden bridge includes providing an elevated pedestal 1100 and two grounding bases 1200, an elevated side frame 2100 and two grounding side frames 2200.

Specifically, one end of the elevated pedestal 1100 is connected to one grounding base 1200, and the other end of the elevated pedestal 1100 is connected to another grounding base 1200, forming a pedestal structure 1000. One end of the elevated side frame 2100 is connected to one grounding side frame 2200, and the other end of the elevated side frame 2100 is connected to another grounding side frame 2200, forming a side scaffold structure 2000. One side of the scaffold structure 2000 is connected to the pedestal structure 1000, forming a bridge. The bridge is placed in the desired location in the garden and fixed.

Furthermore, it includes providing an elevated pedestal 1100 and two grounding bases 1200, two elevated side frame 2100, and four grounding side frames 2200.

Specifically, one end of the elevated pedestal 1100 is connected to one grounding base 1200, and the other end of the elevated pedestal 1100 is connected to another grounding base 1200, forming a pedestal structure 1000. One end of each of the two elevated side frame 2100 is connected to one grounding side frame 2200, and the other end of each of the two elevated side frame 2100 is connected to another grounding side frame 2200, forming a scaffold structure 2000. The two scaffold structures 2000 are connected to both sides of the pedestal structure 1000, forming a bridge. The bridge is placed in the desired location in the garden and fixed.

In this embodiment, the elevated pedestal 1100 includes at least one elevated support rod 1101 and at least one elevated side bar 1102. The grounding base 1200 includes at least one grounding support rod 1201 and at least one grounding side bar 1202.

Wherein, the two ends of the elevated support rod 1101 and the elevated side bar 1102 are provided with at least one threaded hole A 1103. One end of the grounding support rod 1201 and the grounding side bar 1202 is provided with at least one connecting section 1203 and at least one first embedded body 1205. The connecting section 1203 is provided with at least one threaded hole B 1204 corresponding to the threaded hole A 1103.

When the grounding side bar 1202 and the grounding support rod 1201 are inserted into the elevated side bar 1102 and the elevated support rod 1101, respectively, using the first embedded body 1205, and when the elevated pedestal 1100 is placed on the connecting section 1203 of the grounding base 1200, the two grounding bases 1200 are fixedly connected to both ends of the elevated pedestal 1100 using a fixing member, forming a pedestal structure 1000.

In this embodiment, the elevated side frame 2100 includes at least one elevated connecting rod 2102, and the grounding side frame 2200 includes at least one grounding connecting rod 2202.

Wherein, the elevated connecting rod 2102 is provided with at least one through hole C 2104, and the grounding connecting rod 2202 is provided with at least one second embedded body 2205 and at least one through hole D 2204 corresponding to the through hole C 2104.

When forming a scaffold structure 2000, the second embedded body 2205 of the grounding connecting rod 2202 is inserted into the elevated side bar 1102 and the elevated support rod 1101. Then, the two grounding side frames 2200 are fixedly connected to both ends of the elevated side frame 2100 using a fixing member, forming a scaffold structure 2000.

In this embodiment, the elevated side frame 2100 includes at least one elevated bottom pole 2101.

Wherein, the elevated side bar 1102 is provided with at least one through hole E 1104 at both ends, and the elevated bottom pole 2101 is provided with at least one through hole F 2105 corresponding to the through hole E 1104.

When forming a bridge, one side of the scaffold structure 2000 is fixedly connected to the pedestal structure 1000 using a fixing member, or two scaffold structures 2000 are fixedly connected to both sides of the pedestal structure 1000 using a fixing member, forming a structurally stable garden bridge.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The terms "comprising." "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A structurally stable garden bridge comprising at least one set of pedestal structure; and each set of said pedestal structure comprises an elevated pedestal and two grounding bases; and said elevated pedestal is provided with at least one threaded hole A at each end; and wherein one end of said two grounding base contacts a ground and an other end of said two grounding base is provided with at least one connecting section and at least one first embedded body, said at least one connecting section has at least one threaded hole B thereon, said at least one first embedded body is fixedly connected to said elevated pedestal, and said threaded hole A and said threaded hole B are coaxial when said elevated pedestal and said two grounding base are fixedly connected; and at least one set of the scaffold structure; and each set of said at least one set of the scaffold structure comprises one elevated side frame and two grounding side frames; and wherein said elevated side frame comprises at least one elevated bottom pole, at least one elevated connecting rod, at least one elevated top bar, and at least one support pole, each grounding side frame of the two grounding side frames comprises at least one grounding bottom pole, at least one grounding connecting rod, at least one grounding top bar, at least one support pole, and at least one grounding rod, said at least one elevated connecting rod is provided with at least one through bole C, said at least one grounding connecting rod is provided with at least one through hole D corresponding to said at least one through hole C, and said at least one elevated connecting rod and said at least one grounding connecting rod forms a fixed connection by way of a fixing member, the at least one through hole C is provided at each end of said elevated side frame; and wherein one end of said each grounding side frame of two grounding side frame contacts the ground and an other end said of said each grounding side frame is provided with the at least one through hole D and at least one second embedded body, said at least one second embedded body is fixedly coupled to said elevated side frame, and the at least one through hole C and the at least one through hole D-are coaxial when said elevated side frame is fixedly coupled to said each grounding side frame of two grounding side frame, and wherein said elevated pedestal is further provided with at least one through hole E at each end of said elevated pedestal, said at least one through hole E being transverse to said at least one threaded hole A, and said elevated side frame is further provided with at least one through hole F corresponding to said at least one through hole E at each end of said elevated side frame, and said at least one set of the scaffold structure and said pedestal structure are formed into a fixed connection through said at least one through hole E and said at least one through hole F.

2. The structurally stable garden bridge according to claim 1, wherein said pedestal structure and said at least one set of the scaffold structure are hollow structures.

3. The structurally stable garden bridge according to claim 2, wherein said elevated pedestal comprises at least one elevated support rod, at least one elevated side bar and a plurality of crossbars, said plurality of crossbar being laid over said it least one elevated support rod and said at least one elevated side bar and forming a fixed connection with said at least one elevated support rod and said at least one elevated side bar.

4. The structurally stable garden bridge according to claim 3, wherein said two grounding bases comprises at least one grounding support rod, at least one grounding side bar and a plurality of crossbars, said plurality of crossbars being laid over said at least one grounding support rod and said at least one grounding side bar and forming a fixed connection with said at least one grounding support rod and said at least one grounding side bar.

5. The structurally stable garden bridge according to claim 4, wherein at least one threaded hole A is provided at each end of said at least one elevated support rod and said at least one elevated side bar, at least one connecting section is provided at one end of said at least one grounding support rod, and at least one connecting section is provided at one end of said at least one grounding side bar, both said at least one connecting sections being provided with at least one threaded hole B corresponding to said at least one threaded hole A.

6. The structurally stable garden bridge according to claim 5, wherein said at least one elevated support rod forms a fixed connection with said at least one grounding support rod by way of a fixing member, and when said at least one elevated side bar forms a fixed connection with said at least one grounding side bar by way of a fixing member; and one end of said at least one elevated support rod is provided on said at least one connecting section of said at least one grounding support rod when said at least one elevated support rod forms a fixed connection with said at least one grounding support rod, and when said at least one elevated side bar forms a fixed connection with said at least one grounding side bar, and one end of said at least one elevated side bar is provided on said at least one connecting section of said at least one grounding side bar.

7. The structurally stable garden bridge according to claim 1, wherein a lower end of said at least one elevated connecting rod is fixedly connected to an end of said at least one elevated bottom pole, an upper end of said at least one elevated connecting rod is fixedly connected to an end of said at least one elevated top bar, said at least one elevated connecting rod is provided at each end of said at least one elevated bottom pole and said at least one elevated top bar, respectively, and said at least one support pole is provided between said at least one elevated bottom pole and said at least one elevated top bar, parallel to said at least one elevated connecting rod.

8. The structurally stable garden bridge according to claim 1, wherein a lower end of said at least one grounding connecting rod is fixedly connected to an end of said at least one grounding bottom pole, an upper end of said at least one grounding connecting rod is fixedly connected to an end of said at least one grounding top bar, said at least one support pole is disposed between said at least one elevated bottom pole and said at least one elevated top bar parallel to said at least one elevated connecting rod, the other end of said at least one grounding bottom pole is fixedly connected to said at least one grounding rod, the other end of said at least one grounding top bar is fixedly connected to the upper end of said at least one grounding rod, said at least one grounding rod being parallel to said at least one grounding connecting rod.

9. The structurally stable garden bridge according to claim 1, wherein the at least one through hole E is provided at each end of said at least one elevated side bar, and the at least one through hole F corresponding to said at least one through hole E is provided at each end of said at least one elevated bottom pole, and said at least one elevated side bar and said at least one elevated bottom pole form a fixed connection by way of a fixing member.

10. The structurally stable garden bridge according to claim 9, wherein said at least one grounding side bar and said at least one grounding support rod are provided with the first embedded body at one end near said at least one connecting section, said at least one first embedded body having an outer diameter not larger than an inner diameter of said at least one elevated side bar and said at least one elevated support rod, and when said at least one first embedded body is fixedly connected to said elevated pedestal, said at least one first embedded body of said at least one grounding side bar and said at least one grounding support rod is inserted into said at least one elevated side bar and said at least one elevated support rod with a close surface fit.

11. The structurally stable garden bridge according to claim 10, wherein said at least one grounding connecting rod is provided with the at least one second embedded body at a position corresponding to said at least one elevated top bar and said at least one elevated bottom pole, an outer diameter of said at least one second embedded body being not larger than an inner diameter of said at least one elevated top bar and said at least one elevated bottom pole, and when said at least one second embedded body is fixedly connected to said elevated side frame, said at least one second embedded body of said at least one grounding connecting rod is inserted into said at least one elevated top bar and said at least one elevated bottom pole with a close surface fit.

12. The structurally stable garden bridge according to claim 11, wherein said each grounding side frame of two grounding side frame, further comprises at least one reinforcement rod, said at least one reinforcement rod being disposed between said least one support pole and said at least one grounding rod, said at least one reinforcement rod and said at least one support pole being at an angle.

13. The structurally stable garden bridge according to claim 12, wherein at least one grounding section is provided at the bottom end of said at least one grounding rod, and said at least one grounding section is provided with at least one fixing hole.

14. A method of using a structurally stable garden bridge comprising providing an elevated pedestal and two grounding bases, an elevated side frame and two grounding side frames; and connecting one end of said elevated pedestal to one of said two grounding bases and an other end of said elevated pedestal to the other of said two grounding bases to form a pedestal structure;

wherein said elevated pedestal comprises at least one elevated support rod and at least one elevated side bar, and said each grounding base of two grounding bases comprises at least one grounding support rod and at least one grounding side bar, wherein said at least one elevated support rod and said at least one elevated side bar are provided with at least one threaded hole A at each end, said at least one grounding support rod and said at least one grounding side bar are provided with at least one connecting section and at least one first embedded body at one end, and said at least one connecting section is provided with at least one threaded hole B corresponding, to said at least one threaded hole A; and inserting said at least one grounding side bar and said at least one first embedded body of said at least one grounding side bar and said at least one grounding support rod into said at least one elevated side bar and said at least one elevated support rod, and placing said elevated pedestal on said at least one connecting section of said each grounding base of two grounding base, and then connecting two of said two grounding bases to the ends of said elevated pedestal by way of fasteners to form a pedestal structure, connecting one end of said elevated side frame to one of said each grounding side frame of two grounding side frames and the other end of said elevated side frame to the other of said each grounding side frame of two grounding side frames to form a scaffold structure, connecting one of said scaffold structures to one side of said pedestal structure to form a bridge, placing and securing the bridge where it is to be placed in the garden.

15. The method of using a structurally stable garden bridge according to claim 14, wherein it comprises providing an elevated pedestal and two grounding bases, two elevated side frames and four grounding side frames; and connecting one end of said elevated pedestal to one of said two grounding bases and the other end of said elevated pedestal to another of said two grounding bases to form a pedestal structure; and connecting one end of said elevated side frame to one of said each grounding side frame of four grounding side frames and the other end of said two elevated side frame to another of said each grounding side frame of four grounding side frames to form a scaffold structure; and connecting two of said scaffold structures to each side of said pedestal structure to form a bridge; and placing and securing the bridge where it is to be placed in the garden.

16. The method of using a structurally stable garden bridge according to claim 14, wherein said elevated side frame comprises at least one elevated connecting rod and said each grounding side frame of two grounding side frame comprises at least one grounding connecting rod; and wherein said at least one elevated connecting rod is provided with at least one through hole C and said at least one grounding connecting rod is provided with at least one second embedded body and at least one through hole D corresponding to said at least one through hole C; and inserting said at least one second embedded body of said at least one grounding connecting rod into said at least one elevated side bar and said at least one elevated support rod, and then connecting two of said each grounding side frame of two grounding side frames to the ends of said elevated side frame by way of fixing members to form a scaffold structure.

17. The method of using a structurally stable garden bridge according to claim 16, wherein said elevated side frame comprises at least one elevated bottom pole; and wherein at least one through hole E is provided at each end of said at least one elevated side bar and at least one through hole F corresponding to said at least one through hole E is provided at each end of said at least one elevated bottom pole; and two of said scaffold structures are fixedly connected to both sides of said pedestal structure by way of fasteners to form a structurally stable garden bridge.

18. The method of using a structurally stable garden bridge according to claim 17, wherein said each grounding side frame of two grounding side frames further comprises at least one grounding rod, said at least one grounding rod being provided with at least one fixing hole at the bottom end; and placing the structurally stable garden bridge where it is to be placed in a garden and securing it to the ground by way of fasteners.

* * * * *